US006508317B2

(12) United States Patent
Eddison et al.

(10) Patent No.: US 6,508,317 B2
(45) **Date of Patent: *Jan. 21, 2003**

(54) DOWNHOLE APPARATUS AND METHOD OF USE

(75) Inventors: Alan Martyn Eddison, Stonehaven (GB); Ronnie Hardie, Portlethen (GB)

(73) Assignee: Andergauge Limited, Scotland (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/933,302

(22) Filed: Aug. 20, 2001

(65) Prior Publication Data

US 2001/0054515 A1 Dec. 27, 2001

Related U.S. Application Data

(60) Division of application No. 09/194,003, filed on Nov. 18, 1998, now Pat. No. 6,279,670, and a continuation of application No. PCT/GB97/01343, filed on May 16, 1997.

(30) Foreign Application Priority Data

May 18, 1996 (GB) ..... 9610451
Dec. 3, 1996 (GB) ..... 9625096

(51) Int. Cl.[7] ..... E21B 4/02

(52) U.S. Cl. ..... 175/107; 175/317

(58) Field of Search ..... 175/107, 57, 231, 175/232, 296, 317, 318

(56) References Cited

U.S. PATENT DOCUMENTS

| | | | |
|---|---|---|---|
| 2,743,083 | A | 4/1956 | Zublin |
| 2,780,438 | A | 2/1957 | Bielstein |
| 4,819,745 | A | 4/1989 | Walter |
| 4,830,122 | A | 5/1989 | Walter |
| 4,953,595 | A | 9/1990 | Kotlyar |
| 4,979,577 | A | 12/1990 | Walter |
| 5,009,272 | A | 4/1991 | Walter |
| 5,048,622 | A | 9/1991 | Ide |
| 5,190,114 | A | 3/1993 | Walter |

FOREIGN PATENT DOCUMENTS

| | | |
|---|---|---|
| EP | 0 335 543 | 10/1989 |
| GB | 2 059 481 | 4/1981 |

*Primary Examiner*—Thomas B. Will
*Assistant Examiner*—Kristine Markovich
(74) *Attorney, Agent, or Firm*—Alston & Bird LLP

(57) ABSTRACT

Downhole flow pulsing apparatus comprises a housing (14) for location in a drillstring, the housing (14) defining a throughbore to permit passage of fluid through the housing. A valve (27, 30) is located in the bore and defines a flow passage (29, 31). The valve includes a valve member (27) which is movable to vary the area of the passage (29, 31) to provide a varying fluid flow therethrough. A fluid actuated positive displacement motor (15, 16) is associated with the valve member (27). In a preferred embodiment, the apparatus is provided in combination with a drill bit (5) and a pressure responsive device, such as a shock-sub (3), which expands or retracts in response to the varying drilling fluid pressure created by the varying flow passage area. The expansion or retraction of the shock-sub (3) provides a percussive effect at the drill bit.

8 Claims, 6 Drawing Sheets

FLUID FLOW AREA V VALVE ROTATION ANGLE

DOWNHOLE APPARATUS AND METHOD OF USE

CROSS-REFERENCE TO RELATED APPLICATIONS

This application is a divisional of U.S. application Ser. No. 09/194,003, filed Nov. 18, 1998, now U.S. Pat. No. 6,279,670, and PCT/GB97/01343 of May 16, 1997, priority of which is GB9610451.8 of May 18, 1996, which is hereby incorporated herein in its entirety by reference.

This invention relates to downhole apparatus. In particular, but not exclusively, the invention relates to drilling apparatus and a drilling method, and to a flow pulsing method and a flow pulsing apparatus for a drill string.

In the oil and gas exploration and extraction industries it is well known that providing a percussive or hammer effect tends to increase the drilling rate that is achievable when drilling bores through hard rock. In such drilling operations drilling fluid or "mud" is pumped from the surface through the drill string to exit from nozzles provided on the drill bit. The flow of fluid from the nozzles assists in dislodging and clearing material from the cutting face and serves to carry the dislodged material through the drilled bore to the surface. It has been recognised that providing a pulsing fluid flow from the nozzles may also serve to increase the drilling rate.

Apparatus utilising one or both of these principles is described in U.S. Pat. No. 2,743,083 to Zublin, U.S. Pat. No. 2,780,4438 to Bielstein, and U.S. Pat. Nos. 4,819,745, 4,830,122, 4,979,577, 5,009,272 and 5,190,114 all to Walter. A pulsing fluid flow is achieved by restricting the drilling fluid flow area through the apparatus, the restriction creating a pressure force which provides the percussive effect. The flow restriction may be achieved by a variety of means, including valves which rotate about the longitudinal axis of the string, valves which rotate about a transverse axis, axially reciprocating valves and flap valves. The valves members are driven or reciprocated using drilling fluid driven turbines of various forms, or fluid pressure forces created by the movement of the valve member in the flow of drilling fluid.

It is among the objectives of the present invention to provide an improved flow pulsing method and apparatus for a drill string.

In accordance with one aspect of the present invention there is provided flow pulsing apparatus for a drill string, the apparatus comprising:

a housing for location in a drill string above a drill bit, the housing defining a throughbore to permit passage of drilling fluid therethrough;

a valve located in the bore and including first and second valve members each defining a respective axial flow opening and which openings are aligned to collectively define an open axial drilling fluid flow port through the valve, the first member being rotatable about a longitudinal axis of the housing to vary the alignment of the openings and thus vary the open area of said port to, in use, provide a varying flow therethrough and variation of the drilling fluid pressure; and drive means operatively associated with the valve for rotating the first member.

According to another aspect of the present invention there is provided a flow pulsing drilling method comprising the steps:

providing a valve in a drill string bore including first and second valve members each defining a respective axial flow opening and which openings collectively define an open axial flow port through the valve; and rotating the first member about a longitudinal axis to vary the alignment of the openings such that the open area of said axial flow port varies with said rotation to provide variable flow therethrough and thus produce varying fluid pressure in the drilling fluid.

The provision of an open axial flow port minimises the possibility of the port becoming blocked by large particles or debris carried by the drilling fluid into the housing. Further, the use of first and second valve members which rotate relative to one another facilitates clearing of the port if any particles or debris should become lodged in the valve.

The apparatus may form part of a rotary drilling string, that is a string that is rotated from surface, or may be incorporated in a downhole drilling motor and use the rotary drive of the motor to rotate the first valve member.

Preferably also, the valve openings are of similar shape such that when the openings are aligned the maximum flow area of the axial flow port corresponds to the area of each opening: the axis of rotation of the first valve member may be offset from the second member such that rotation of the first member moves the openings out of alignment; or the axes of non-circular openings may coincide. In the preferred embodiment the valve openings are in the form of transverse slots on a common axis.

Preferably also, the drive means is driven by passage of drilling fluid therethrough. Most preferably, the drive means is in the form a positive displacement motor.

Preferably also, the apparatus includes a pressure responsive device which will expand or retract in response to the varying drilling fluid pressure created by operation of the apparatus; this expansion or retraction provides the desired percussive effect at the drill bit. The device, which may be in the form of a shock sub or tool, may be provided above or below the valve. Alternatively, the valve may form part of such a device.

In accordance with another aspect of the present invention there is provided downhole flow pulsing apparatus, the apparatus comprising:

a housing for location in a string, the housing defining a throughbore to permit passage of fluid therethrough;

a valve located in the bore defining a flow passage and including a valve member, the valve member being movable to vary the area of the flow passage to, in use, provide a varying fluid flow therethrough; and a fluid actuated positive displacement motor operatively associated with the valve for driving the valve member.

The use of a positive displacement motor provides for alignment; or the axes of non-circular openings may coincide. In the preferred embodiment the valve openings are in the form of transverse slots on a common axis.

Preferably also, the drive means is driven by passage of drilling fluid therethrough. Most preferably, the drive means is in the form a positive displacement motor.

Preferably also, the apparatus includes a pressure responsive device which will expand or retract in response to the varying drilling fluid pressure created by operation of the apparatus; this expansion or retraction provides the desired percussive effect at the drill bit. The device, which may be in the form of a shock sub or tool, may be provided above or below the valve. Alternatively, the valve may form part of such a device.

In accordance with another aspect of the present invention there is provided downhole flow pulsing apparatus, the apparatus comprising:

a housing for location in a string, the housing defining a throughbore to permit passage of fluid therethrough;

a valve located in the bore defining a flow passage and including a valve member, the valve member being movable to vary the area of the flow passage to, in use, provide a varying fluid flow therethrough; and a fluid actuated positive displacement motor operatively associated with the valve for driving the valve member.

The use of a positive displacement motor provides for close control of the rate at which the drive member is driven; typically, the speed of the motor is directly proportional to the rate of flow of fluid through the motor. Thus, the frequency of the changes in fluid flow may be subject to the same close control.

Preferably, the positive displacement drive motor includes a rotor and the rotor is linked to the valve member. Most preferably, the rotor is utilised to rotate the valve member. The rotor may be linked to the valve member via a universal joint which accommodates any transverse movement of the rotor. Alternatively, the rotor is linked to the valve member and communicate its transverse movement to the valve member. In this situation, the valve member may cooperate with a second valve member, each valve member defining a flow port, the alignment of the flow ports varying with the transverse movement of the first valve member.

Preferably also, the positive displacement motor operates using the Moineau principle. Such motors include a lobed rotor which rotates within a lobed stator, the stator having one more rotor than the rotor. The preferred embodiment of the present invention includes a 1:2 Moineau motor, that is the rotor has one lobe and the stator has two lobes.

These and other aspects of the present invention will now be described, by way of example, with reference to the accompanying drawings, in which.

Figure 1:
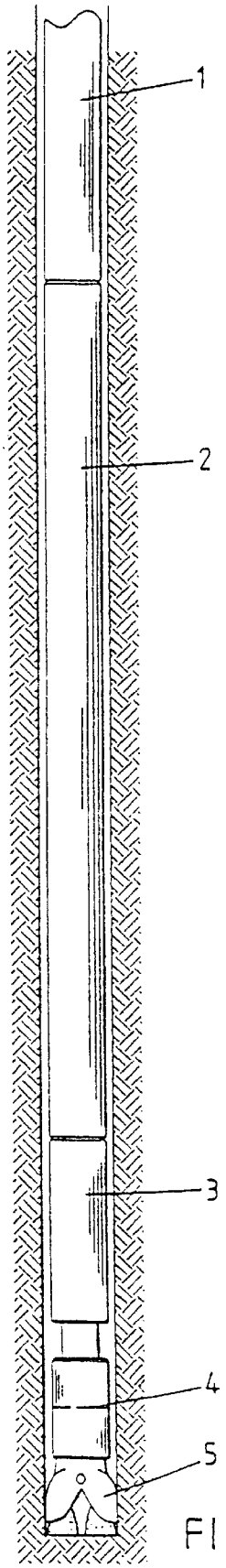
FIG. 1 illustrates the lower end of a drill string provided with flow pulsing apparatus in accordance with a first embodiment of the present invention.

Referring first to FIG. 1 of the drawings, the lower end of a drill string is shown and comprises a drill collar 1 connected to a percussion sub 2, the percussion sub 2 in turn being connected to a shock sub 3 which is attached to a connecting sub 4 which in turn is connected to a drill bit 5. All attachments are by way of conventional threaded connection. The string is shown located in a bore with the drill bit 5 in contact with the cutting face.

Figure 2:
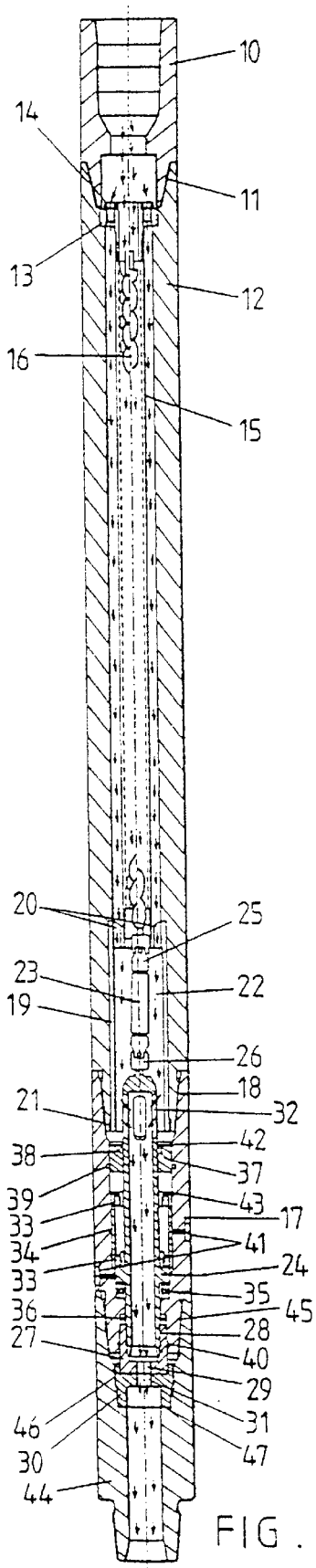
FIG. 2 is a somewhat enlarged sectional view of the percussion sub of FIG. 1.
Figure 3:
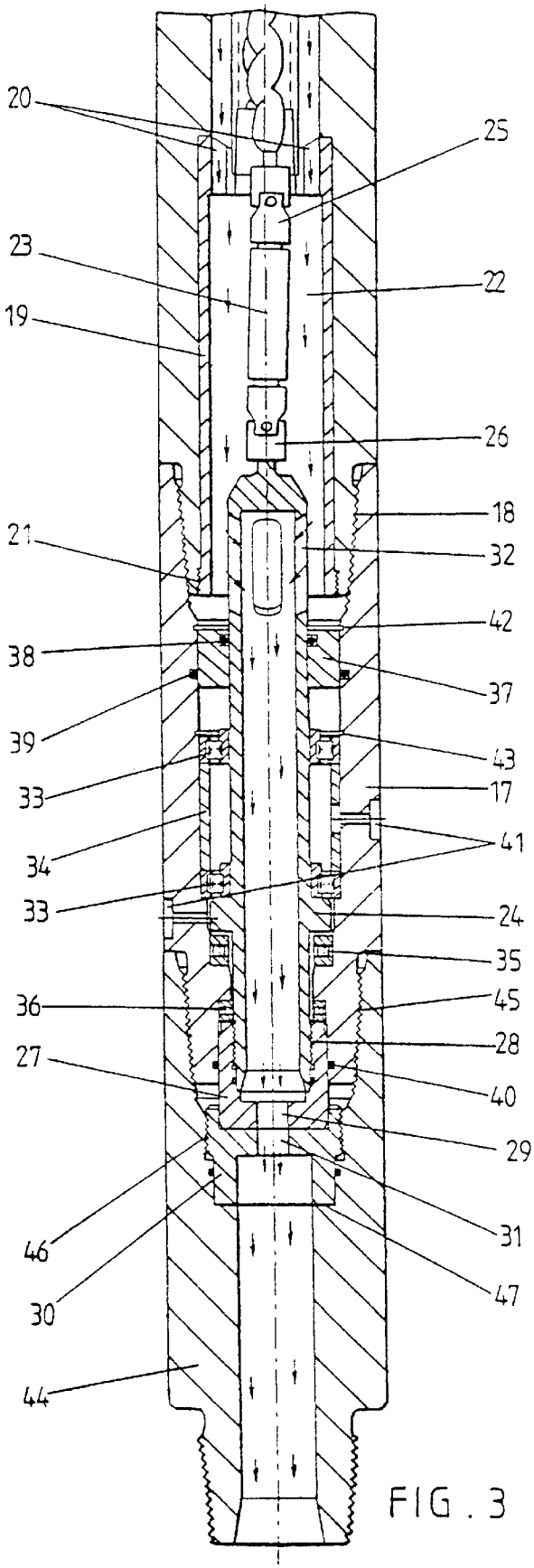
FIG. 3 is an enlarged sectional view of the valve of the percussion sub of FIG. 2.

Reference is now also made to FIGS. 2 and 3 of the drawings which illustrates aspects of the percussion sub 2 in greater detail. The sub 2 comprises a top section 10 connected by a threaded joint 11 to a tubular main body 12. A flow insert 13 is keyed into the main body 12 and flow nozzles 14 are screwed into the flow insert 13. The keyed flow insert 13 is attached to a motor stator 15 which contains a freely revolving rotor 16. The motor is of the positive displacement type, operating using the Moineau principle. The top section 10, keyed flow insert 13, flow nozzles 14, motor stator 15 and the main body 12 all allow drilling fluid to pass through the sub 2; in use, high velocity drilling fluid enters the top section 10. The flow is then channelled through the flow insert 13 and the flow nozzles 14. A balanced flow rate is achieved between the flow insert 13 and the flow nozzles 14 allowing the drilling fluid to rotate the rotor 16 at a defined speed in relation to the drilling fluid flow rate.

The lower end of the motor stator 15 is supported within a tubular insert 19 which has a threaded connection at its lower end 21 and has fluid passageways 20 to allow fluid to flow from the flow nozzles 14 over the motor stator 15 and into a chamber 22 defined by the insert 19.

The rotor 16 is connected at its lower end to a shaft 23 which in turn is connected to a tubular centre shaft 24. The shaft 24 extends into an intermediate outer body 17 connected to the main body 12 by way of a threaded connection. The connecting shaft 23 is located at either end by a universal joint 25 and 26. The rotor torque is thus directly translated through the connecting shaft 23 and universal joints 25 and 26 to the centre shaft 24.

Figure 4:
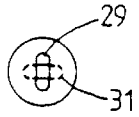
FIG. 4 is a plan view of valve members of the percussion sub of FIG. 2.

A first valve plate 27 is attached to the lower end of the centre shaft 24 via a threaded connection 28. The valve plate 27 defines a slot opening 29, as shown in FIG. 4 of the drawings, which provides a fluid passageway for drilling fluid to flow onto the fixed second valve plate 30 which also defines a slot 31; the slots 29, 31 thus define an open axial flow passage. The fixed valve plate 30 is attached to an end body 44 by way of threaded connection 46.

Figure 5:
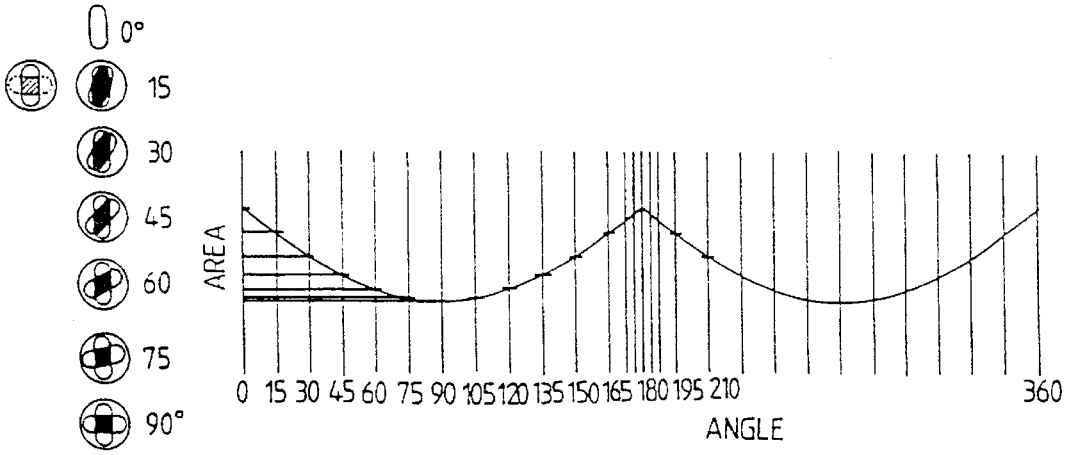
FIG. 5 is a graph illustrating the fluid flow area through the valve of the percussion sub of FIG. 2 versus the valve member relative rotation angle.

Drilling fluid is channelled through radial slots 32 in the upper end of the centre shaft 24 into the centre of the shaft 24 whilst the shaft rotates. Fluid then travels through the first slot 29 and as the two slots 29 and 31 rotate into and out of alignment with each other fluid flow is restricted periodically, causing a series of pressure pulses, as illustrated in FIG. 5 of the drawings. These pressure pulses are used to provide a percussive action along the axis of the equipment to the drill bit 5, as described below. This percussive action increases the drill bit penetration rate in hard rock. It also causes a fluctuation in the drilling fluid flow rate at the bit which also provides more effective means to clean cuttings away from the bit during drilling.

Radial bearings 33 in two positions are used to locate the revolving centre shaft 24. A spacer 34 is located between the bearings 33 to distance them. Thrust bearings 35, 36 are utilised to support and restrict longitudinal movement of the shaft. An oil compensation sleeve 37, seals 38, 39, and oil filler assembly 41 are used to retain an oil supply at a balanced pressure to supply the bearings and seals with lubrication. Circlips 42 and 43 are used as assembly retention devices.

The intermediate outer body 17 is connected to the end body 44 via threaded connection at 45 and the gap between the fixed valve plate 30 and the valve plate 27 is kept to a minimum using shims 47.

Figure 6:
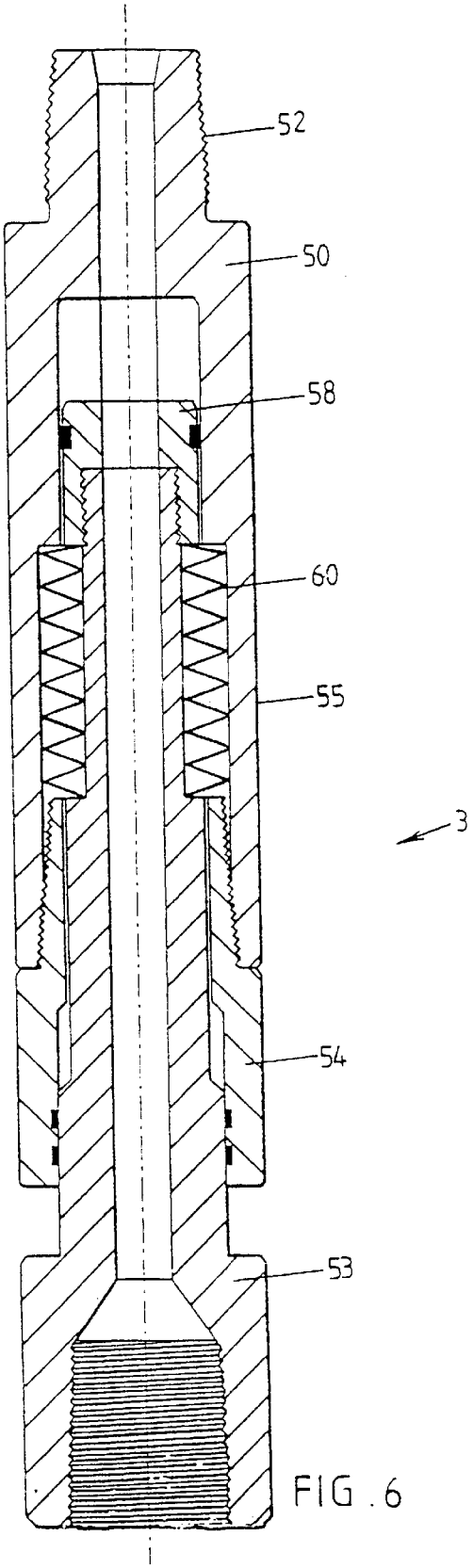
FIG. 6 is a sectional view of the shock-sub of the apparatus of FIG. 1.

Reference is now made to FIG. 6 of the drawings, which illustrates a shock sub arrangement 3 in greater detail; it should be noted that the illustrated arrangement is merely one example of a shock sub suitable for use with the invention. The sub 3 includes an upper body 50 which is connected to the valve and body 44 via a threaded connection 52. The upper body 50 is threaded to a lower body 54 and collectively the upper and lower bodies 50 and 54 define a housing 55 which slidably receives a mandrel 56 which is splined to the lower body 54. A hollow piston 58 is threaded to the upper end of the mandrel 56 such that a positive pressure differential between the drilling fluid in the sub and the drilling fluid in the bore annulus externally of the sub will tend to extend the mandrel 56 from the housing 55. A compression spring in the form of a stack of Belleville washers 60 is provided between a shoulder on the mandrel 56 and a lip on the upper body 50. The spring is also retained between the thread end on the lower body 54 and the hollow piston 58, thus the washer stack provides a resistive spring force in both axial directions.

The lower end of the mandrel 56 is attached to the connecting sub 4 and thus is linked to the drill bit 5. As drilling fluid passes through the percussion sub 2, the first valve plate 27 rotates and the valve slots 29 and 31 rotate into alignment: at this point the fluid available to the shock sub 3 is increased forcing the hollow piston 58 and the mandrel 56 downwards onto the drill bit 5 producing the required intermittent force for the percussive action. At the same time maximum drilling fluid pressure differential is available across the bit ensuring a surge of drilling fluid at the bit at the same instance the percussive impact takes place.

Figure 7:
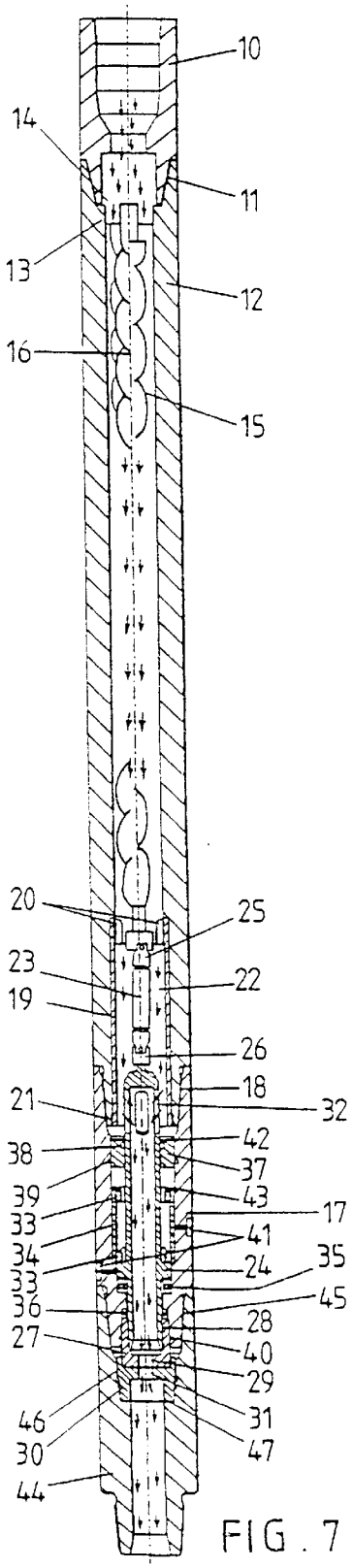
FIG. 7 is a sectional view of a percussion sub in accordance with another embodiment of the present invention.

Reference is now made to FIG. 7 of the drawings which shows part of an alternative embodiment of the invention in which a larger positive displacement motor is used. With this configuration the total flow passes through the motor and none of the drilling fluid is diverted past the power section containing the stator 15*a* and rotor 16*a*. This arrangement provides greater control of percussion frequency because the frequency will be directly proportional to the drilling fluid flow rate.

Figure 8:
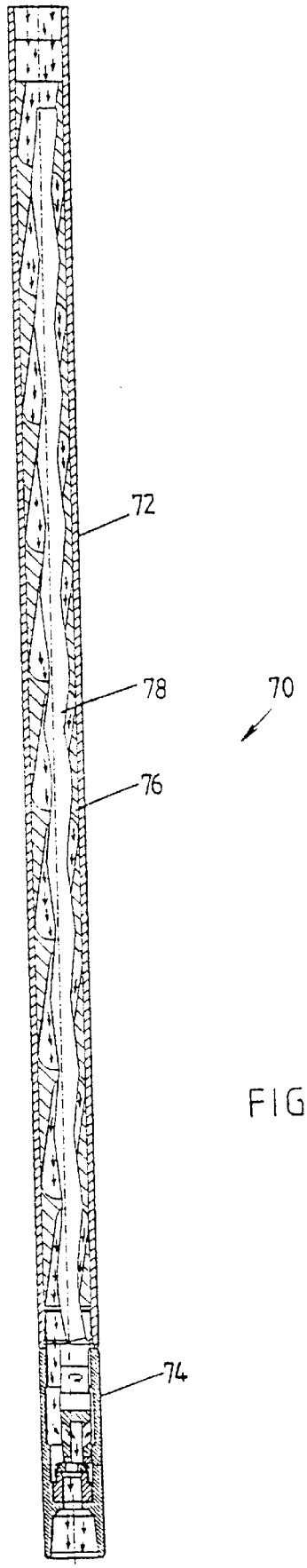
FIG. 8 is a sectional view of a downhole flow pulsing apparatus in accordance with a third aspect of the present invention.
Figure 9:
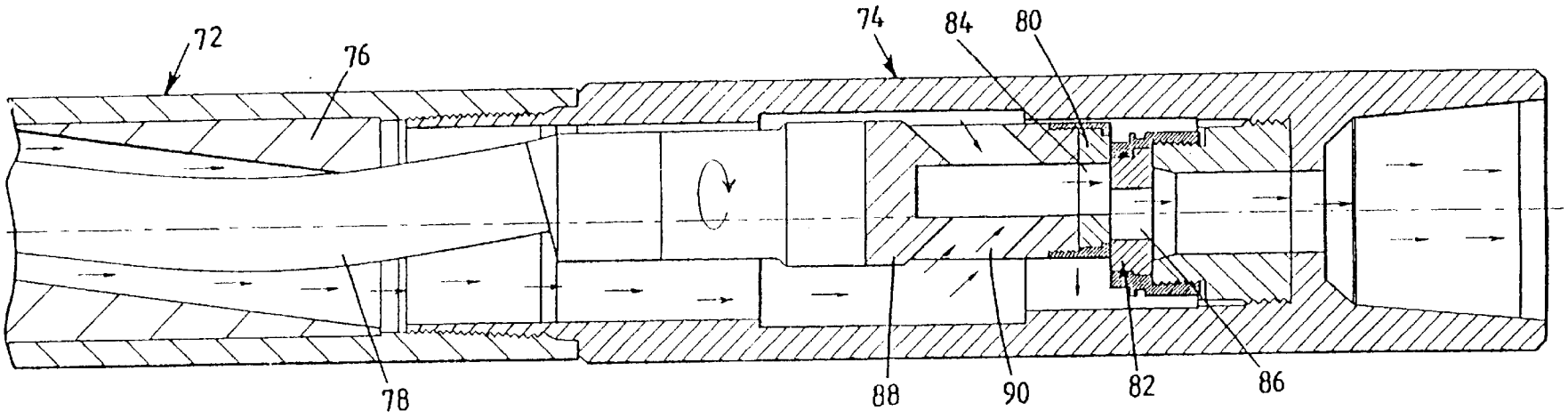
FIG. 9 is a an enlarged sectional view of area 8 of FIG. 8.

Reference is now made to FIGS. 8 and 9 of the drawings which illustrate flow pulsing apparatus 70 in accordance with a third embodiment of the present invention. As with the first described embodiment, the apparatus 70 is intended for location on the lower end of a drill string above a drill bit. As will be described, the apparatus may be used in conjunction with a shock sub or other apparatus to provide a percussive or hammer action or may be used solely to provide a pulsed flow of fluid to the drill bit.

The apparatus 70 includes an elongate tubular body having an upper motor section 72 and a lower valve section 74. The motor section 72 accommodates a Moineau principle motor having a two lobe elastomeric stator 76 and a single lobe rotor 78. The valve section 74 accommodates first and second valve plates 80, 82, each defining a flow port 84, 86. The first valve place 80 is directly mounted on the lower end of the rotor 78 via a ported connector 88 defining flow passages 90 which provide fluid communication between the variable geometry annulus defined between the stator 76 and the rotor 78 and the flow port 84. The second valve plate 82 is mounted on the valve section body 74 directly below the first valve plate 80 such that the respective flow ports 84, 86 coincide. As the rotor 78 rotates it oscillates from side-to-side and this movement is transferred directly to the valve plate 80 to provide a cyclic variation in the flow area defined by the flow ports 84, 86, similar to that described above with reference to the first described embodiment.

The fluctuating fluid flow rate and fluid pressure which is produced by the operation of the valve may be used to operate a shock sub or may be used to move a reciprocating mass which impacts on an anvil, both with the aim of providing a percussive or hammer action to assist in drilling in hard rock. The variation in fluid flow rate may also be utilised, alone or in conjunction with a percussive or hammer tool, to provide pulsed flow of drilling fluid from the drill bit nozzles.

As will be evident to those of skill in the art this embodiment of the invention is of relatively simple construction and thus may be robust and relatively inexpensive to manufacture and maintain. This is achieved, in part, by utilising the oscillation of the rotor of the positive displacement motor, in contrast to conventional uses of such motors in which every effort is made to negate or isolate this movement.

It will be clear to those of skill in the art that these embodiments are merely exemplary of the present invention and that various modifications and improvements may be made thereto without departing from the scope of the invention. The above described embodiments utilise 1:2 Moineau principle motors, but of course other configurations of Moineau motors, such as 2:3 or 3:4 motors, may be utilised to provide different torque or speed characteristics and perhaps permit the motor to be used to drive additional devices, and other forms of positive displacement motors may be utilised.

What is claimed is:

1. Flow pulsing apparatus for a drill string, the apparatus comprising:

a housing for location in a drill string above a drill bit, the housing defining a throughbore to permit passage of drilling fluid therethrough;

a valve located in the bore and including first and second valve members each defining a respective axial flow opening and which openings are aligned to collectively define an open axial drilling fluid flow port through the valve, the first member being rotatable about a longitudinal axis of the housing to vary the alignment of the openings between a first alignment in which the openings collectively define an open axial flow port of a first open area and a second alignment in which the openings collectively define an open axial flow port of a second open area greater than said first open area to, in use, provide a varying flow therethrough and variation of the drilling fluid pressure; and drive means operatively associated with the valve for rotating the first member.

2. The apparatus of claim 1 wherein the axis of rotation of the first valve member is offset from the second member such that rotation of the first member moves the openings out of alignment.

3. The apparatus of claim 2 wherein the valve openings are in the form of transverse slots on a common axis.

4. The apparatus of claim 1 wherein the valve openings are non-circular.

5. Flow pulsing apparatus for drill string, the apparatus comprising:

a housing for location in a drill string above a drill bit, the housing defining a throughbore to permit passage of drilling fluid therethrough;

a valve located in the bore and including first and second valve members each defining a respective axial flow opening and which openings are aligned to collectively define an open axial drilling fluid flow port through the valve, the valve member openings being of similar shape such that when the openings are aligned the maximum flow area of the axial flow port corresponds to the area of each opening, the first member being rotatable about a longitudinal axis offset from a longitudinal axis of the second member such that rotation of the first member moves the openings between a first alignment in which the openings collectively define an open axial flow port of a first open area and a second alignment in which the openings collectively define an open axial flow port of a second open area greater than said first open area to, in use, provide a varying flow therethrough and variation of the drilling fluid pressure; and drive means operatively associated with the valve for rotating the first member.

6. Downhole apparatus comprising:

a housing for location in a tubing string, the housing defining a throughbore to permit passage of fluid therethrough;

a valve located in the throughbore and defining a flow passage and including a valve member, the valve member being transversely movable to vary the area of the flow passage to, in use, provide a varying fluid flow therethrough; and a fluid actuated positive displacement motor having a rotor coupled to the valve member for communicating transverse movement of the rotor to the valve member.

7. Downhole apparatus comprising:

a housing for location in a tubing string, the housing defining a throughbore to permit passage of fluid therethrough;

a device including a member which is transversely movable relative to an axis of the housing; and a fluid actuated positive displacement motor having a rotor coupled to the member for communicating transverse movement of the rotor to the member.

8. A flow pulsing drilling method comprising the steps:

providing a valve in a drill string bore including first and second valve members each defining a respective axial flow opening and which openings collectively define an open axial flow port through the valve, the first member being rotatable about a longitudinal axis of the housing to vary the alignment of the openings, the openings being arranged such that in a complete rotation of the first member about said longitudinal axis the openings are always at least partially aligned and the axial flow port varies in area between a minimum first open area when the first member is positioned in a first alignment and a maximum second open area when the first member is positioned in a second alignment; and rotating the first member about said longitudinal axis to vary the alignment of the openings between said first alignment and said second alignment to provide variable flow therethrough and thus produce varying fluid pressure in the drilling fluid.

* * * * *